US005772571A

United States Patent [19]

Marcle-Geller et al.

[11] Patent Number: 5,772,571

[45] Date of Patent: Jun. 30, 1998

[54] DEVICE FOR CHANGING MODES OF OPERATION OF A PAPER-CONDUCTING CYLINDER OF A FOLDER

[75] Inventors: Thierry Marcle-Geller, Senlis; Thierry Quentin, La Croix St. Quen; Thierry Thevenin, Margny Les Complègne, all of France

[73] Assignees: Heidelberg Harris S.A., Montataire Cedex, France; Heidelberger Druckmaschinen AG, Heidelberg, Germany

[21] Appl. No.: 549,064

[22] Filed: Oct. 27, 1995

[30] Foreign Application Priority Data

Oct. 27, 1994 [FR] France ..... 94 12907

[51] Int. Cl.[6] ..... B31F 1/10

[52] U.S. Cl. ..... 493/426; 493/476; 493/425

[58] Field of Search ..... 493/424, 425, 493/426, 427, 428, 429, 430, 431, 432, 433, 434, 435, 475, 476; 83/304, 305

[56] References Cited

U.S. PATENT DOCUMENTS

| | | | |
|---|---|---|---|
| 3,865,361 | 2/1975 | Neal . | |
| 4,332,582 | 6/1982 | Hertrich . | |
| 4,352,671 | 10/1982 | Petersen | 493/424 |
| 5,000,433 | 3/1991 | Prim et al. | 493/424 |
| 5,297,462 | 3/1994 | Creaden | 493/475 |
| 5,327,804 | 7/1994 | Creaden | 493/475 |
| 5,351,589 | 10/1994 | Creaden | 493/475 |
| 5,443,437 | 8/1995 | Mack . | |

FOREIGN PATENT DOCUMENTS

| | | |
|---|---|---|
| 0 355 595 | 2/1990 | European Pat. Off. . |
| 0 335 190 | 8/1993 | European Pat. Off. . |
| 2 375 127 | 7/1978 | France . |

*Primary Examiner*—James F. Coan
*Assistant Examiner*—John Paradiso
*Attorney, Agent, or Firm*—Herbert L. Lerner; Laurence A. Greenberg

[57] ABSTRACT

Device for converting or changing a mode of operation of a paper-conducting cylinder of a folder having at the circumference thereof at least one element for operating on the paper conducted by the cylinder, a disc having a peripheral contour forming a control cam for at least one actuating element for generating a movement of the operating element, and a device for moving the control disc, independently of a drive therefor, so as to switch the mode of the paper-conducting cylinder between operating on the paper and not operating on the paper, includes at least one first adjustment element activatable axially and angularly by remote control for radially moving the actuating element, and at least one second adjustment element activatable by remote control for axially moving the control disc.

23 Claims, 7 Drawing Sheets

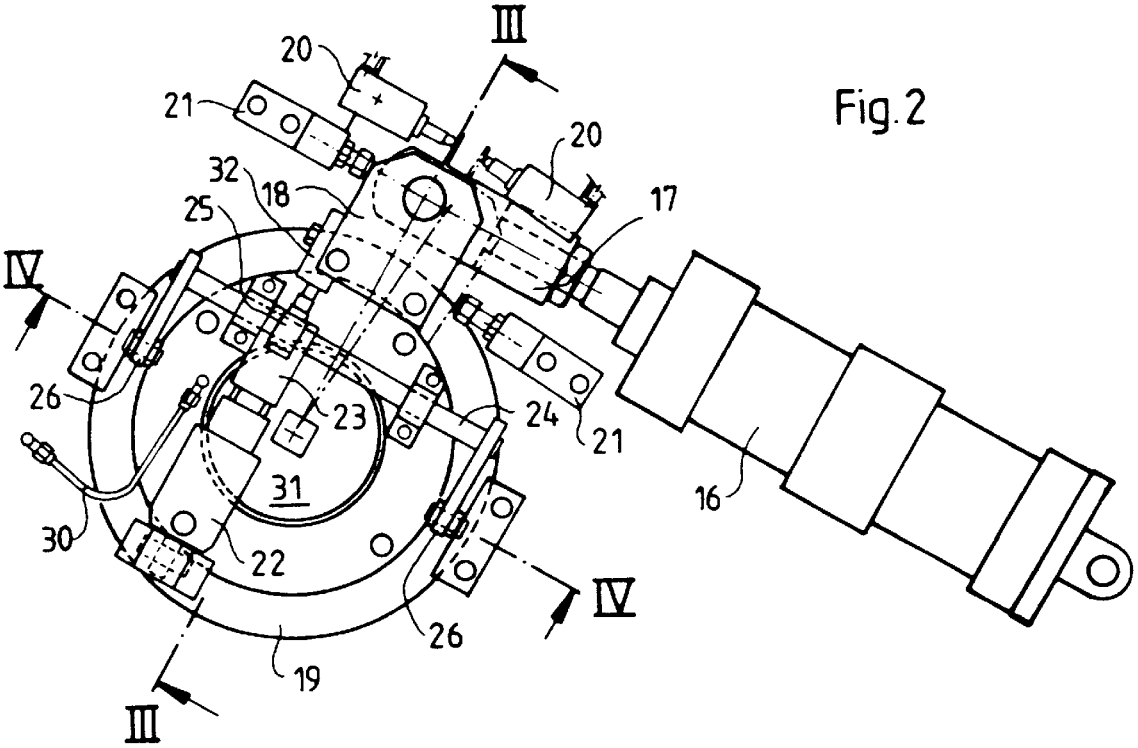
Fig. 2
Fig. 5
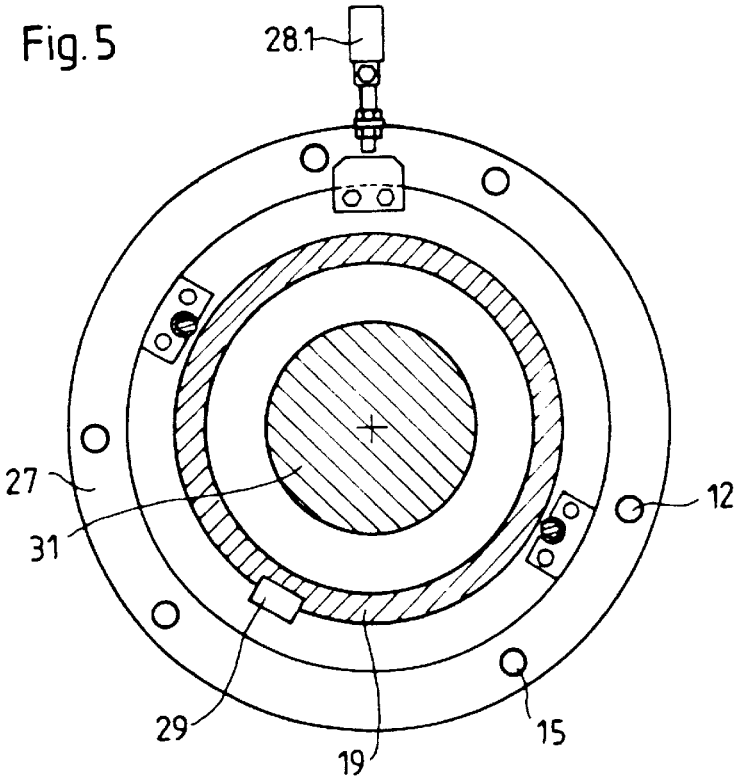

VII 47
5.1
6.1
1.1
5.2
6.2
46
38.1
41
38.2
38
35
30
39
36
37
40
34
5
1.2
6
13
8
44
43
VII

DEVICE FOR CHANGING MODES OF OPERATION OF A PAPER-CONDUCTING CYLINDER OF A FOLDER

BACKGROUND OF THE INVENTION

Field of the Invention

The invention relates to a device for converting or changing the modes of operation of a paper-conducting cylinder of a folder, more specifically, for causing, for example, a collecting cylinder of a folder to convert between collecting and non-collecting productions, a draw cylinder of a folder to convert between drawing and non-drawing, a tucker-blade cylinder of a folder to concert between forming a crease and not forming a crease, a folding cylinder of a folder to convert between folding and non-folding, and the like. In the case of the collecting cylinder, that cylinder is equipped at its perimeter with at least one folding or tucker blade and with at least one set of holding elements, a control disc for the folding or tucker blade having a peripheral contour forming a control cam for actuating elements generating a movement of the folding blade, a control disc for the holding elements having a peripheral contour forming a control cam for actuating elements generating a movement of fastening elements, and a device for moving one of the control discs, independently of the drive, for switching between the collecting production and non-collecting production.

The published European Patent Document EP-A-0 355 595 A2 discloses a folder including a collecting cylinder equipped with holding elements in the form of grippers, and folding blades. Elements for actuating the holding elements and the folding blades may be activated by respective control cams which are provided with hollow control zones. On relief or projection holders mounted coaxially with the control cams, covering reliefs or projections are formed which are movable radially and which thus cover or overlap the control zones of the control cams into which a feeler or sensing roller of the actuating elements forming part of the holding elements or of the folding blades would otherwise fall. A second feeler roller mounted beside the first feeler roller rolls over the cover relief or projection, covering or overlapping the control zone of the control cam. Thus, the first feeler roller is prevented from falling into the control zone.

In commercial web offset printing, in which a small to medium number of pages are printed, the mechanical complexity which goes hand-in-hand with this solution, is no longer tolerable.

The published European Patent Document EP 0 335 190 B1 describes a folding and collecting cylinder of a folder. In this construction, stationary tucker-blade and pin cam discs and driven tucker-blade cam and pin cam covering discs can be found adjacent one another. The two covering or overlapping discs are driven by a separate drive mechanism independently of the main drive. The drive mechanism acts upon a gearwheel which, in turn, acts upon a hollow pinion, worm toothing being provided on a hollow cylindrical appendage thereof. An axial movement of the hollow pinion produces a conversion or change in mode of the folder between collecting production and non-collecting production.

In this last-described construction in the state of the art, as with that of the previously mentioned published European Patent Document EP-A-0 355 595 A2, recourse is had to covering discs which can furthermore be driven separately.

Two feeler or sensing rollers, one of which runs over the covering disc, while the other runs over the corresponding cam disc, are thus required per set of holding elements or per set of folding or tucker blades.

Starting from the aforementioned state of the art, it is an object of the invention to provide a device for converting or changing the mode of a collecting cylinder of a folder, wherein the transition of a collecting cylinder from collecting production to non-collecting production is automated, while the mechanical complexity is reduced.

With the foregoing and other objects in view, there is provided, more particularly, in accordance with the invention, a device for converting or changing a mode of operation of a paper-conducting cylinder of a folder having at the circumference thereof at least one element for operating on the paper conducted by the cylinder, a control disc having a peripheral contour forming a control cam for at least one actuating element for generating a movement of the operating element, and a device for moving the control disc, independently of a drive therefor, so as to switch the mode of the paper-conducting cylinder between operating on the paper and not operating on the paper, comprising at least one first adjustment element activatable axially and angularly by remote control for radially moving the actuating element, and at least one second adjustment element activatable by remote control for axially moving the control disc.

In accordance with another feature of the invention, the paper-conducting cylinder is a draw cylinder.

In accordance with a first alternative feature of the invention, the paper-conducting cylinder is a tucker-blade cylinder.

In accordance with a second alternative feature of the invention, the paper-conducting cylinder is a folding cylinder.

In accordance with a third alternative feature of the invention, the paper-conducting cylinder is a collecting cylinder.

In accordance with another aspect of the invention, there is provided a device for causing a collecting cylinder of a folder to convert or change mode between collecting and non-collecting productions, the cylinder being equipped at its periphery with at least one folding blade and with at least one set of holding elements, a permanently driven control disc for the folding blade having a peripheral contour forming a control cam for actuating elements generating a movement of the folding blade, a permanently driven control disc for the holding elements having a peripheral contour forming a control cam for actuating elements generating a movement of the holding elements, and a device for moving one of the control discs, independently of the drive, for switching between the collecting production and the non-collecting production, comprising first adjustment elements activatable axially and angularly by remote control for radially moving the actuating elements of the folding blade and of the holding elements, and second adjustment elements activatable by remote control for axially moving the permanently driven control discs.

In accordance with another feature of the invention, the converting device includes transmission members connecting the adjustment elements to an adjustment member.

In accordance with an added feature of the invention, one of the adjustment elements has an annular form and is mounted on a bushing.

In accordance with a further feature of the invention, the annular adjustment element includes first and second relief or projecting members formed as fingers, which are insertable into recesses formed in a segment of the folding blade as well as in a perforation segment of the collecting cylinder.

In accordance with an additional feature of the invention, the converting device includes position sensors for detecting the position of the annular adjustment element.

In accordance with yet another feature of the invention, the converting device includes a lateral wall wherein the bushing is fitted so that it can turn angularly through the intermediary of other adjustment elements.

In accordance with yet a further feature of the invention, the converting device includes folding-blade levers fitted on a blade shaft and actuatable by the first finger-shaped relief members.

In accordance with yet an added feature of the invention, the converting device includes holding-element levers carried by a holding-element shaft and actuatable by the second finger-shaped relief members.

In accordance with yet an additional feature of the invention, the annular adjustment element is provided together with a device for blocking rotation thereof on the bushing.

In accordance with still another feature of the invention, the converting device includes a bushing, the transmission members and the adjustment member being mounted on the bushing for performing an axial movement.

In accordance with still a further feature of the invention, the converting device includes other adjustment members for angularly turning the bushing, the transmission members being connected to and actuatable by the first-mentioned adjustment member independently of at least one of the other adjustment members for angularly turning the bushing.

In accordance with still an added feature of the invention, the control discs, respectively, include two separate bearing surfaces for the actuating elements for moving the folding knives and the holding elements.

In accordance with still an additional feature of the invention, the actuating elements for the folding knives and for the holding elements are mounted on the collecting cylinder and constitute a single feeler roller.

In accordance with another feature of the invention, the converting device includes a control disc holder carrying the control discs on a separately driven sleeve, the control disc holder being movable axially between positions.

In accordance with a further feature of the invention, the actuating elements, during the axial movement of the control disc holder, stop in a position remote from the control discs.

In accordance with another aspect of the invention, there is provided a converting device in combination with convertible collecting cylinders of a folder, the collecting cylinders have a diameter corresponding to an odd number of copies to be transported on the periphery thereof.

In accordance with an added feature of the invention, the converting device includes a sliding guide for initiating the axial movement of the control discs.

In accordance with a concomitant feature of the invention, the converting device includes an angularly movable annular adjustment element having a fingerlike extension, and an adjustment member for angularly moving the annular adjustment element so as to cause the movement of the control discs between a first axial position and a second position, and in reverse.

An advantage of the foregoing construction according to the invention is that it makes it possible to dispense with covering discs, radial movement or adjustment of the covering reliefs or projections, as well as a separate drive of the covering discs may be dispensed with if the elements for actuating the holding elements as well as the folding blades can be moved or adjusted radially. Furthermore, while the actuating elements have no contact with the bearing surfaces formed on the control cams, an axial movement of the control cam is possible in order to convert from collecting production to non-collecting production or the reverse.

Because the stopping of the actuating elements by the control discs and the associated axial movement of the control discs can be performed by remote control, time-consuming in-phase positioning, as well as using tools for a conversion or mode-change operation is unnecessary; the conversion or mode change process occurs considerably faster and drastically reduces the required make-ready time.

The first adjustment elements for radially moving the elements for actuating the folding knives and the holding elements are connected to an adjustment member by transmission members; in particular, an annular adjustment element is provided, mounted on a bushing. The annular adjustment element has at least one pair of first and second reliefs or projections in the form of fingers, one of which is insertable into openings formed in the segment of the folding blade and the other into recesses formed in a segment of the holding element of the collecting cylinder. The position of the annular adjustment element can be detected by position sensors; furthermore, the bushing can be mounted on the annular adjustment element and can be turned angularly by the adjustment elements.

Folding blade levers mounted on a blade shaft are actuatable by the first finger-shaped reliefs or projections, while the second finger-shaped reliefs or projections can actuate holding element levers mounted on a holding element shaft. In order to transmit the angular movement from the bushing to the finger-shaped reliefs or projections, the annular adjustment element is provided on the bushing with a device for blocking its rotation.

The transmission members and the adjustment member for executing an axial movement are mounted on the bushing, thereby assuring that an independent axial movement of the adjustment member used for the angular movement of the bushing will be achieved.

The control discs for activating the holding elements and folding blades include, respectively, two bearing or contact surfaces separated from one another, while the folding blades and the holding elements mounted on the collecting cylinder, respectively, carry, as actuating elements, an individual feeler roller. An axial movement of the control discs mounted in a control disc holder may, for example, be initiated by a sliding guide or coulisse. The angular or radial movement of an annular adjustment element, including a finger-shaped relief or projection, results in the movement of the control discs between a first position and a second position, and the reverse.

Other features which are considered as characteristic for the invention are set forth in the appended claims.

Although the invention is illustrated and described herein as embodied in a device for changing mode of a collecting cylinder of a folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIG. 2 is a plan view of devices for axially and angularly moving switching or converting components.

FIG. 5 is a cross-sectional view of FIG. 3 taken along the line V—V in the direction of the arrows;

DESCRIPTION OF THE PREFERRED EMBODIMENT

Figure 1A:
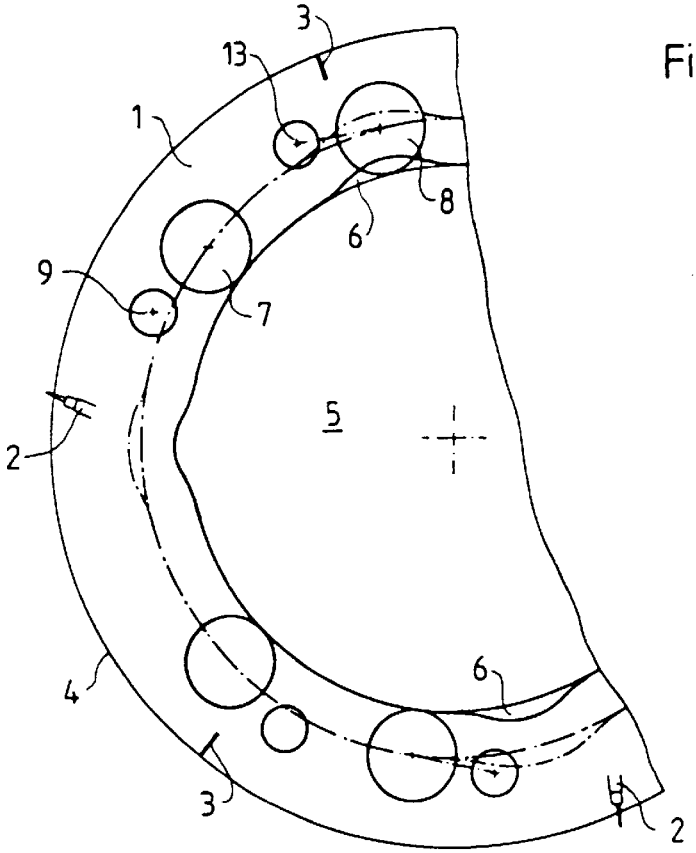
FIG. 1*a* is an end view of a collecting cylinder with three pairs of actuating elements for holding elements and folding knives.

Referring now to the drawings and, first, particularly to

FIG. 1*a* thereof, there is diagrammatically represented therein a collecting cylinder 1 which can be converted from collecting operation to non-collecting operation. On the periphery or circumference 4 of the collecting cylinder 1, there are provided three sets of holding elements 2 (two of which are represented) and three folding or tucker blades 3 (two of which are represented). Actuating elements 7 and 8 in the form of feeler, sensing or follower rollers run on control cams 5 and 6. The feeler roller 8 for actuating the folding blade 3 runs on the perimeter of the control cam 5, while the feeler roller 7 for actuating the holding elements 2 runs on the control cam 6. The control cams 5 and 6, respectively, are provided on the peripheral contours thereof with reliefs or projections which, the instant the feeler rollers 7 and 8 pass over them, activate the folding blades 3 or the holding elements 2.

Figure 1B:
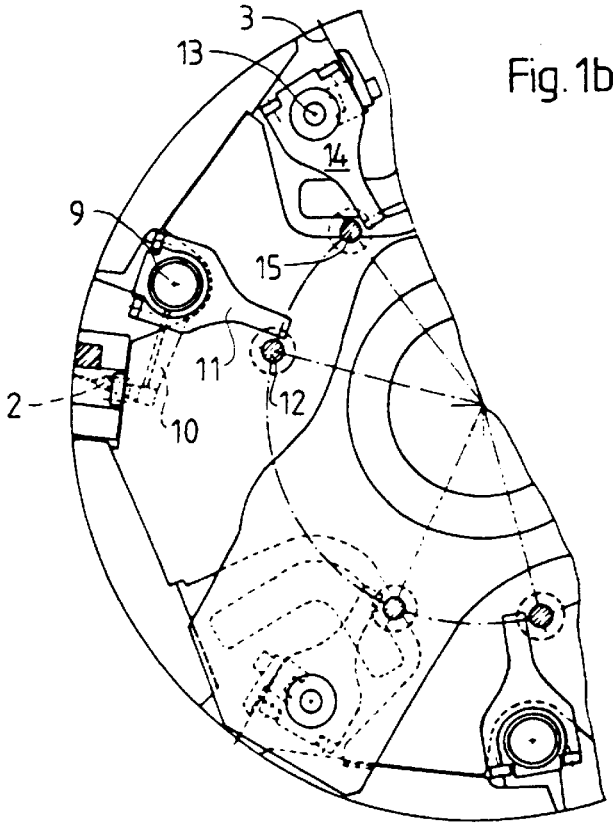
FIG. 1*b* is a view of a pin holder and of a tucker-blade bearing on the collecting cylinder.

FIG. 1*a* represents a collecting cylinder 1 which transports three copies on the perimeter 4 thereof. However, it could quite equally well relate to a collecting cylinder 1 which has a diameter permitting five or seven copies, i.e., an odd number of copies, to be transported. FIG. 1*b* presents a side view of the holding elements and of the tucker or folding blades for transverse or crossfolding.

A holding element shaft 9 carries levers 10, at the end of which a holding element 2, shown herein in broken lines as a punch needle, is mounted. Furthermore, an actuating lever 11 is fixed to the holding element shaft 9. Facing the free end of the actuating lever 11 is a first relief or projection 12 in the form of a finger which, when rotating in clockwise direction, causes the holding element shaft 9 to turn in the counter-clockwise direction.

A folding or tucker blade 3 for forming a transverse or crossfold is fixed on a blade shaft 13. A blade lever 14 mounted on the blade shaft 13 extends radially relative to the axis of rotation of the collecting cylinder 1. Facing the free end of the blade lever 14 is a second relief or projection 15 in the form of a finger. When the latter moves in clockwise direction, the blade shaft 13 turns in the opposite direction.

In the embodiment represented in FIG. 1*b*, a first relief or projection 12 and a second relief or projection 15 in the form of fingers form a pair. Three pairs of reliefs or projections (only two of which are represented) are provided, which makes it possible to activate three sets of holding elements 2 or folding blades 3.

FIG. 2 is a plan view of the components which permit the axial and angular or radial movements during the switching or conversion of a collecting cylinder.

For the angular movement of a bushing 19 which is mounted in a lateral wall of a folder, recourse is had to an adjustment member 16. This may be an operating cylinder, a motor or an electromagnet. A fork 17 which is connected to a flange 18 is mounted on the adjustment member 16. The flange 18 is fixed to the bushing 19. On the flange 18 is a finger which actuates two terminal switches 20, in order to determine the angular position of the bushing 19. Adjacent the flange 18, there are two travel limiting devices 21 by means of which the travel of the flange 18 and, therefore, the extent of rotation of the bushing 19 may be influenced. With the adjustment member 16, it is therefore possible to cause the bushing 19 to turn angularly in both directions.

On the bushing 19, there is another adjustment member 22, shown herein as an operating cylinder. To the adjustment member 22, there is fixed a fork 23 permitting a shaft 24, which is mounted on a cover, to turn. Two transmission members 26 in the form of adjustment rods are fixed on the shaft 24 which is turnable by means of a lever 25. Because the shaft 24 is eccentric relative to the axis of symmetry of the journal 31 of the cylinder, a rotation of the shaft 24, produced by the adjustment member 22, gives rise to an axial movement of the transmission members 26 perpendicularly to the plane of the drawing.

Figure 3:
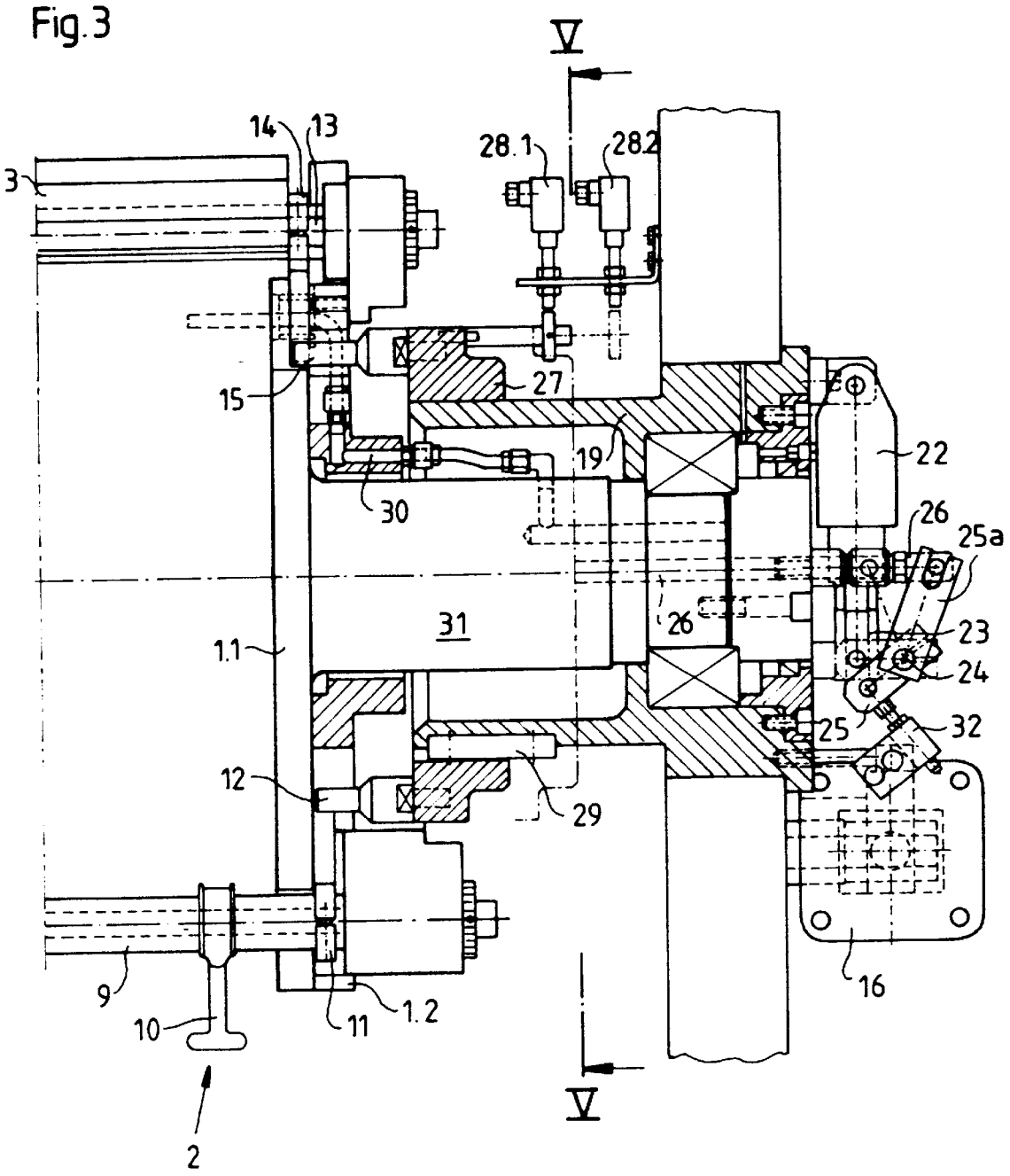
FIG. 3 is a cross-sectional view of FIG. 2 taken along the line III—III in the direction of the arrows.

FIG. 3 is a sectional view taken along the line III—III of FIG. 2.

The adjustment members 16 and 22 and the components interacting with them are disposed in the region of the bushing 19. By means of a roller bearing, the journal 31 of the cylinder is mounted in the bushing 19. On the latter, there is an annular adjustment element 27 which can be moved axially on the bushing 19. To the annular adjustment element 27, there is fixed a spindle which includes a disc. By means of the spindle, the axial position of the annular adjustment element 27 is able to be observed, via position sensors 28.1 and 28.2 fixed to the lateral wall of the folder. The first and second reliefs or projections 12 and 15, respectively, in the shape of a finger, are fixed to the annular adjustment element 27. During an axial movement of the annular adjustment element 27, effected by the transmission members 25 and 26 as well as by the adjustment member 22, the first relief or projection 12 in the shape of a finger passes behind the actuating lever 11 of the holding element support 1.2 of the collecting cylinder 1. At the same time, the second relief or projection 15 in the form of a finger, also fixed to the annular adjustment element 27, moves behind the blade lever 14 on the blade support 1.1. If the adjustment member 16 causes an angular movement of the bushing 19, the annular adjustment element 27 is also moved angularly, due to the rotation-blocking device 29. The reliefs or projections 12 and 15 inserted into the respective supports 1.1 and 1.2 of the collecting cylinder are also moved angularly or radially and, via the levers 11 and 14, effect a rotation of the shafts 9 and 13. Because the actuating elements 7 and 8 are connected to the shafts 9 and 13, the actuating elements 7 and 8 (note FIGS. 1*a* and 1*b*) are moved away from the respective bearing surfaces of the control cams 5 and 6.

It ought also to be mentioned that a lubricant supply 30 passes through the journal 31 of the cylinder and another, non-movable bushing. Furthermore, on the outer side of the bushing 19, there is provided a travel-limiting or terminal switch 32 which detects the excursion of the lever 25.

Figure 4:
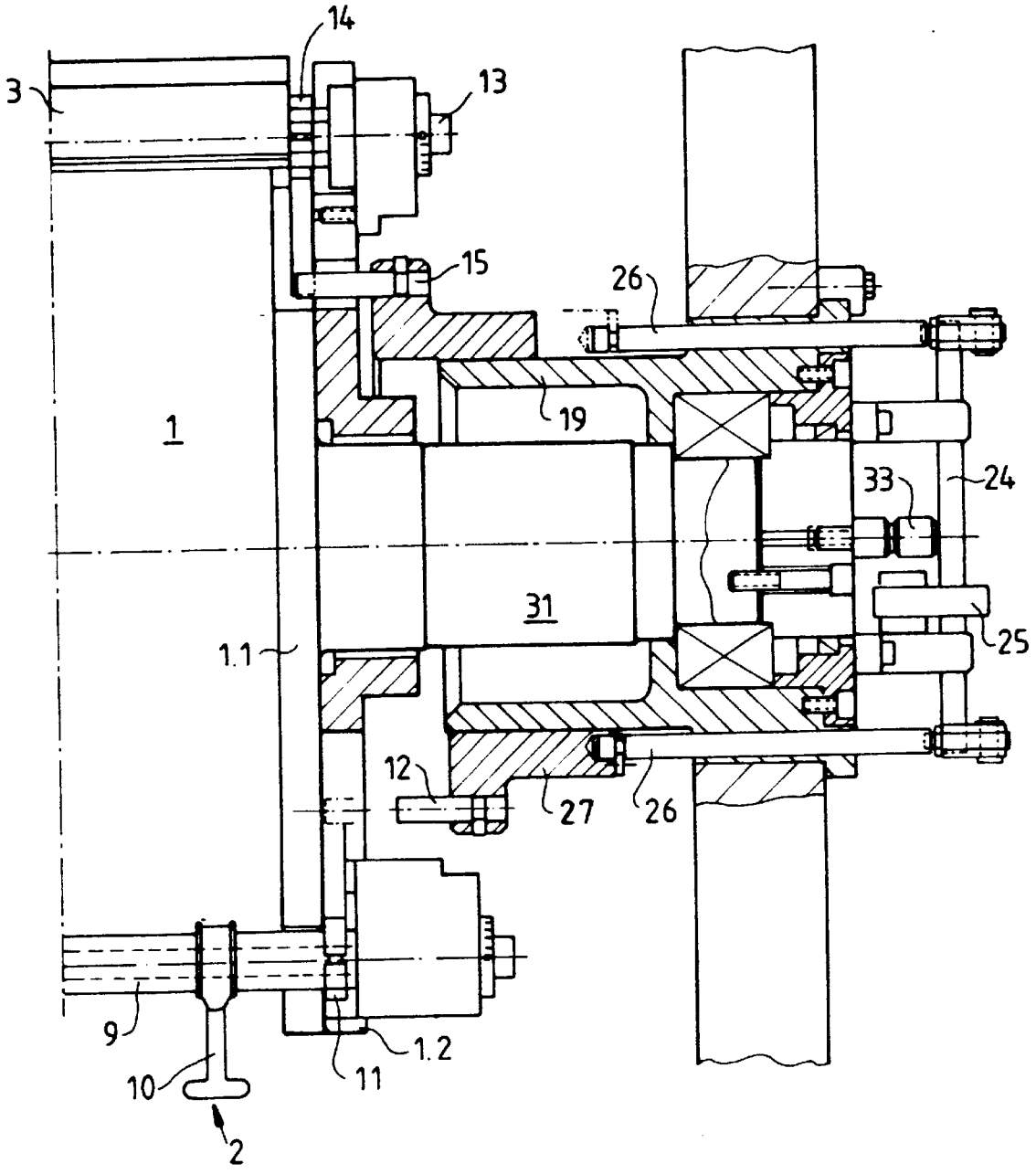
FIG. 4 is a cross-sectional view of FIG. 2 taken along the line IV—IV in the direction of the arrows.

FIG. 4 is a sectional view taken along the line IV—IV of FIG. 2.

This figure shows that the shaft 24 is supported in bearings which are fixed to a cover screwed to the bushing 19. By means of the lever 25, the shaft 24 is turnable, so that the adjustment rods 26 can be moved axially. In the upper half of FIG. 4, the second relief or projection 15 in the form of a finger, is represented in a position located behind the blade lever 14. The set-back position of the annular adjustment element 27 is represented in phantom. In the lower half of FIG. 4, the first relief or projection 12 in the form of a finger is represented in a position in which it is withdrawn from the holding-element support 1.2. As a consequence, the annular adjustment element 27, connected to the adjustment rod 25, is in its set-back position. Represented in phantom is a position in which the first relief 12 in the form of a finger is pulled out behind the actuating lever 11 of the holding-element support 1.2.

FIG. 5 is a view of the annular adjustment element and a fragmentary sectional view taken along the line V—V of FIG. 3.

On the periphery of the annular adjustment element 27, first and second reliefs or projections 12 and 15, formed as fingers, are provided in pairs. As in the aforedescribed FIGS. 3 and 4, the second reliefs or projections 15, in the form of fingers which penetrate into the blade support 1.1, are longer than the first reliefs or projections 12, also formed as fingers, which penetrate into the holding-element support 1.2 directed towards the annular adjustment element 27. Mounted on the bushing 19 is the axially extending device 29 for blocking or preventing rotation, one of the position sensors being shown at 28.1.

Figure 6:
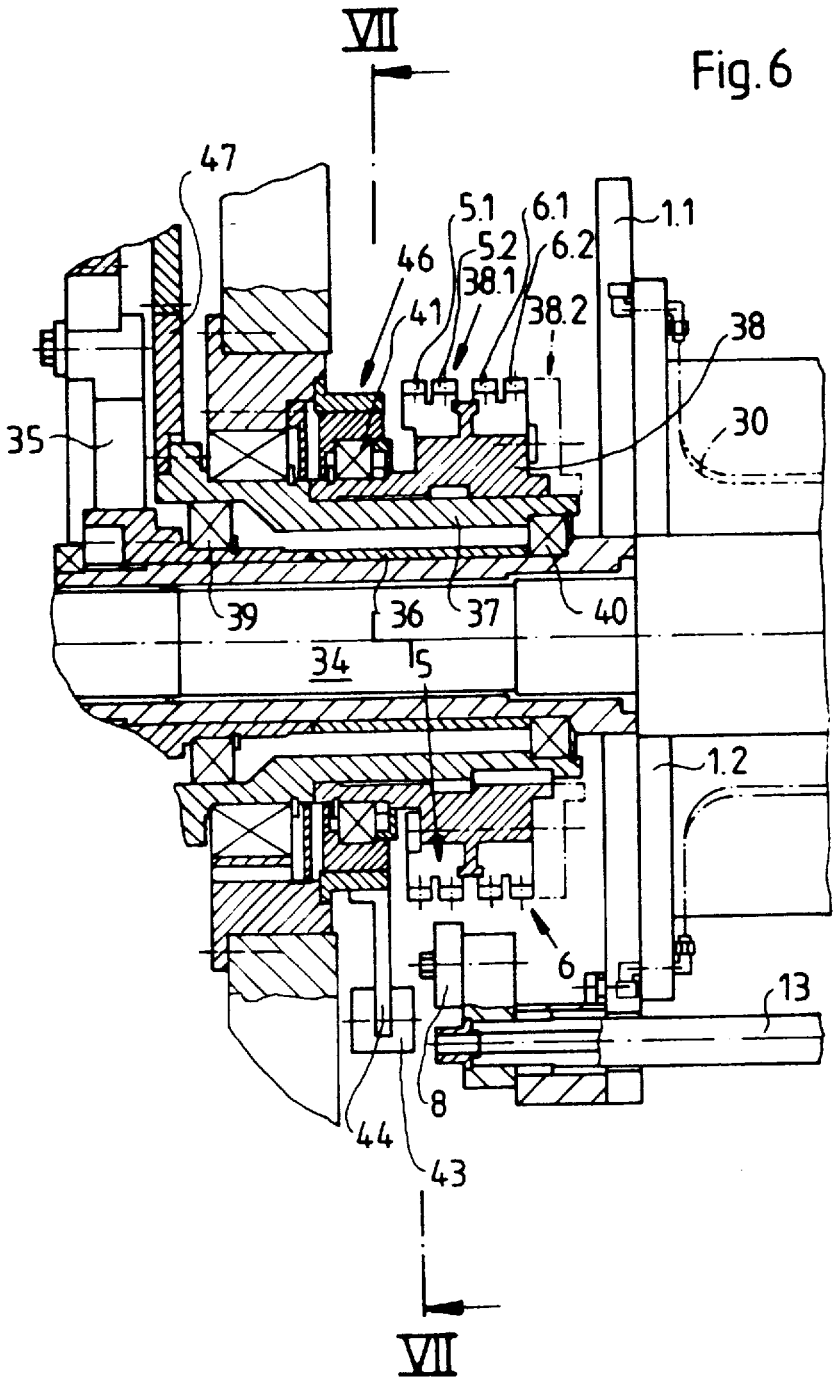
FIG. 6 is a sectional view of a bearing support for the collecting cylinder on the drive side.

FIG. 6 is a drive-side view of the bearing support for the collecting cylinder.

A first bushing or sleeve 36 which drives the blade support 1.1 of the collecting cylinder 1 is, in turn, driven by a drive wheel 35. A cylinder journal 34, which is connected to the holding-element support or segment 1.2 of the collecting cylinder 1 and which turns at the same peripheral speed as that of the blade support 1.1, is driven by a non-illustrated drive wheel. A second bushing or sleeve 37 is supported by roller bearings 39 and 40 mounted on the first bushing 36. This sleeve 37 is driven by a drive wheel 47 at a different speed from the drive speed of the supports or segments 1.1 and 1.2 of the collecting cylinder 1. A control cam holder 38 is provided on the second bushing or sleeve 37. The control cams 5 and 6 are fastened to the control cam holder 38.

Figure 7:
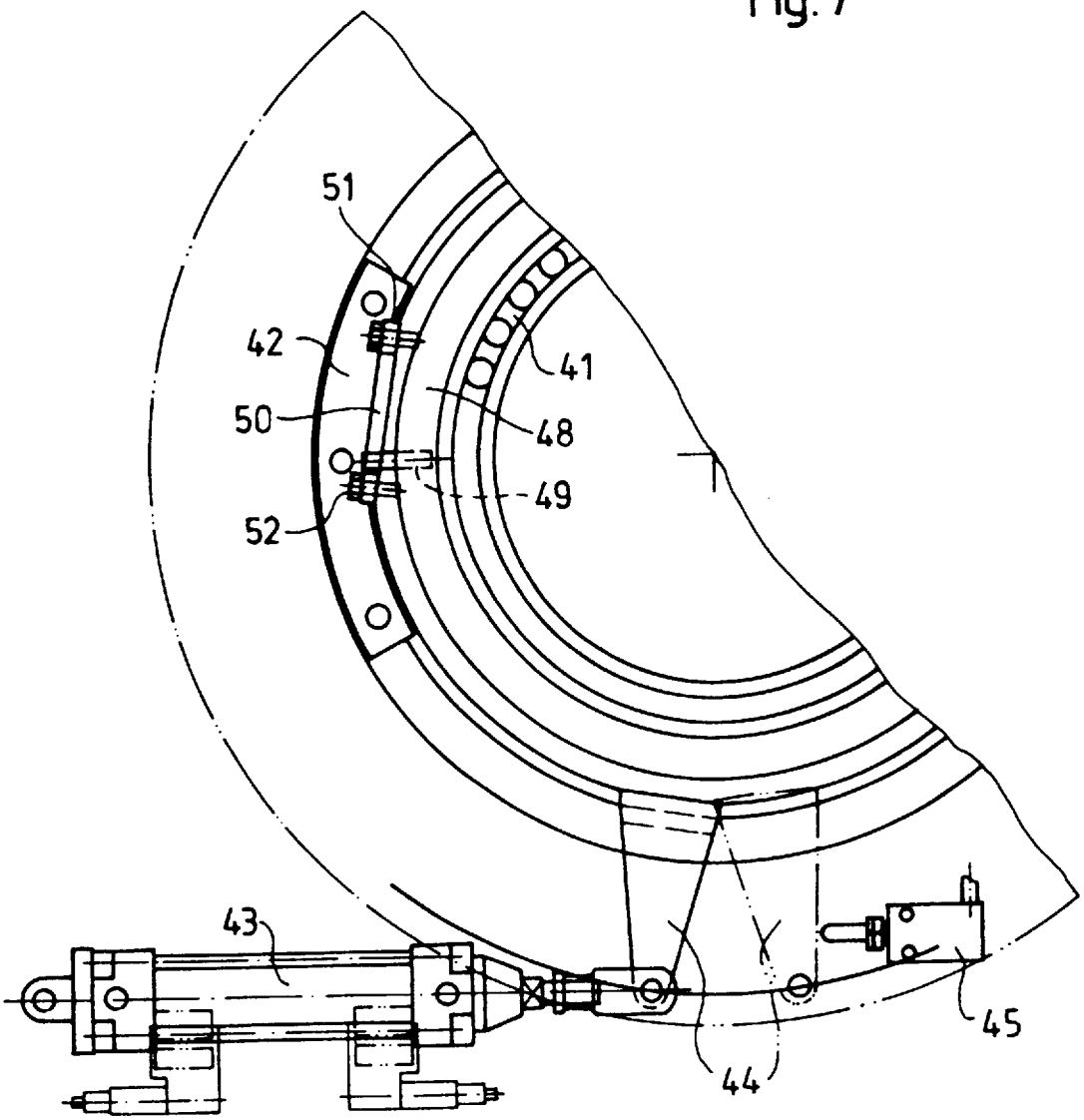
FIG. 7 is a fragmentary sectional view of FIG. 6 taken along the line VII—VII in the direction of the arrows.
Figure 8:
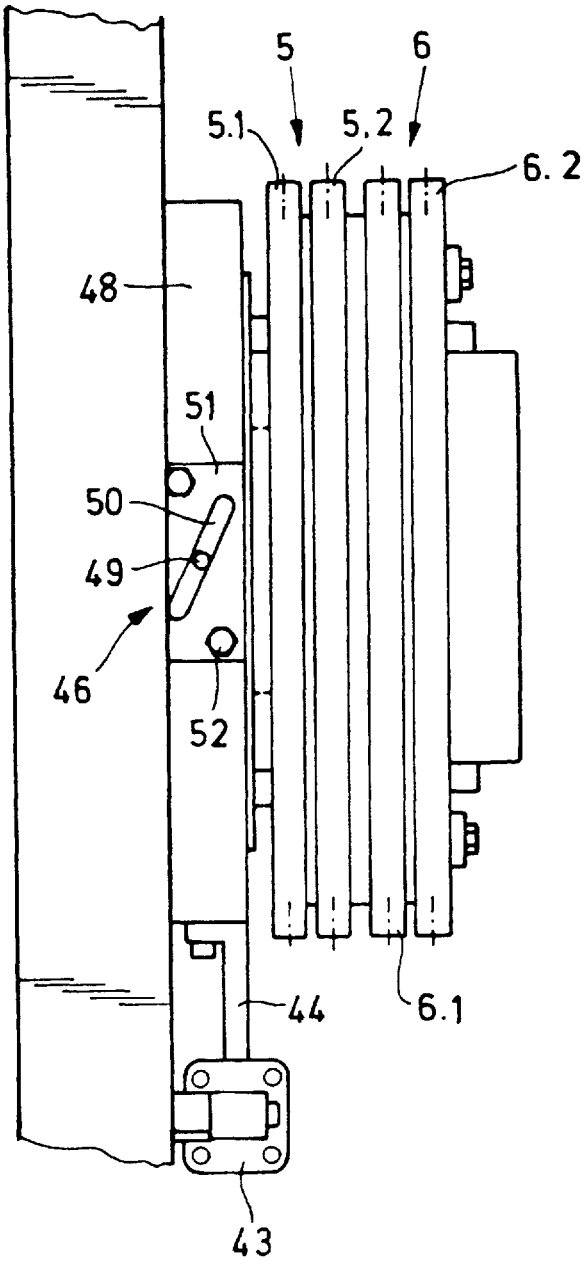
FIG. 8 is a side elevational view of the control device for the axial movement of the control discs.

An adjustment device 46, which is shown more particularly in FIGS. 7 and 8, is mounted by means of a roller bearing 41 on the control cam holder 38. The roller bearing 41 is fixed to the control cam holder 38 at both sides in axial direction.

The control cams 5 and 6, respectively, have two bearing tracks. The control cam 5 for actuating the blade has a bearing track 5.1 for the "non-collecting" mode and a bearing track 5.2 for the "collecting" mode. The same is true for the control cam 6 of the holding elements 2. Bearing tracks 6.1 and 6.2 of the control cam 6 are used to actuate the holding elements 2 via the individual feeler roller 7, while the feeler rollers 8 for actuating the blades 3 run on the bearing tracks 5.1 and 5.2 of the control cam 5. The bearing track 6.1 produces a movement of the holding elements 2 in the "non-collecting" mode, whereas the bearing track 6.2 defines the instants of time at which the holding elements 2 are actuated in the "collecting" mode.

If, as mentioned hereinbefore with reference to FIG. 3, the various feeler rollers 7 and 8 are radially separated from the bearing tracks 5.2 and 6.2, i.e., in the "collecting" mode, the control cam holder 38 can be moved into the second position 38.2 thereof represented in FIG. 6 in phantom.

Then, by rotating the annular adjustment element 27, the actuating levers 11 and 14, respectively, are returned, and the shafts 9 and 13 therefore rotate back again, so that the individual feeler rollers 7 and 8 of the various holding elements 2 and folding blades 3 can reposition themselves on the bearing tracks 5.1 and 6.1 in accordance with the "non-collecting" mode. The bearing tracks 5.1 and 6.1 of the control cams 5 and 6 employed herein for a collecting cylinder 1 for three copies have two lobes, whereas the bearing tracks 5.2 and 6.2 of the cams 5 and 6 have just one lobe which corresponds to the "collecting" mode.

In a collecting cylinder which accepts five copies on the peripheral surface thereof, the bearing tracks 5.1 and 6.1 have four lobes, the bearing tracks 5.2 and 6.2 having just two lobes. In a collecting cylinder which accepts up to seven copies on the periphery thereof, the bearing tracks 5.1 and 6.1 have six lobes, whereas the bearing tracks 5.2 and 6.2 have three lobes.

FIG. 7 represents one possible construction for effecting a radial or angular adjustment on the drive side.

The adjustment member 43, for example, a cylindrical adjustment unit supplied with compressed air, moves a lever 44 which is connected to an annular adjustment element 48. The axial movement of the adjustment cylinder 43 is converted into a rotational movement of the annular adjustment element 48. A relief or projection in the form of a finger 49 is mounted in this annular adjustment element 48, and is movable in a slot 50 formed in a guide element 51. This guide element 51 is mounted via bolts 52 on a fastening element 42.

As can be seen in FIG. 8, the slot 50 is in an inclined position in the guide element 51. An effect of the inclination of the slot 50 in the guide element 51 is that, due to the rotation of the annular adjustment element 48, the relief or projection in the form of a finger 49, which is fixed to the ring 48, transmits an axial movement to the control cam holder 38. Accordingly, the control discs 5 and 6 which have respective bearing surfaces 5.1, 5.2; 6.1, 6.2, can be moved into different positions.

Because the contours of the bearing surfaces 5.1, 5.2.; 6.1, 6.2 are different depending upon whether the operation is taking place in collecting or non-collecting mode, the control rollers 7 and 8 running on the respective bearing surfaces are repositioned after the axial movement of the control discs 5 and 6.

Because the conversion or mode-change operations are initiated by means of operating or adjustment cylinder units, the conversion process progresses automatically by remote control, which considerably reduces the make-ready or preparation time. Furthermore, time-consuming in-phase positioning of the individual adjustment members can be dispensed with, because the risk of collision during a conversion or change in mode is eliminated due to the angular or radial movement or adjustment of the actuating members.

We claim:

1. Device for converting or changing a mode of operation of a paper-conducting cylinder of a folder having at the circumference thereof at least one element for operating on the paper conducted by the cylinder, a control disc having a peripheral contour forming a control cam for at least one actuating element for generating a movement of the operating element, and a device for moving the control disc, independently of a drive therefor, so as to switch the mode of the paper-conducting cylinder between operating on the paper and not operating on the paper, comprising at least one first adjustment element activatable axially and angularly by remote control for radially moving the actuating element, and at least one second adjustment element activatable by remote control for axially moving the control disc.

2. Mode-changing device according to claim 1, wherein the paper-conducting cylinder is a draw cylinder.

3. Mode-changing device according to claim 1, wherein the paper-conducting cylinder is a tucker-blade cylinder.

4. Mode-changing device according to claim 1, wherein the paper-conducting cylinder is a folding cylinder.

5. Mode-changing device according to claim 1, wherein the paper-conducting cylinder is a collecting cylinder.

6. Device for converting or causing a collecting cylinder of a folder to change mode between collecting and non-collecting productions, the cylinder being equipped at its periphery with at least one folding blade and with at least one set of holding elements, a permanently driven control disc for the folding blade having a peripheral contour forming a control cam for actuating elements generating a movement of the folding blade, a permanently driven control disc for the holding elements having a peripheral contour forming a control cam for actuating elements generating a movement of the holding elements, and a device for moving one of the control discs, independently of the drive, for switching between the collecting production and the non-collecting production, comprising first adjustment elements activatable axially and angularly by remote control for radially moving the actuating elements of the folding blade and of the holding elements, and second adjustment elements activatable by remote control for axially moving the permanently driven control discs.

7. Device according to claim 6, including transmission members connecting said adjustment elements to an adjustment member.

8. Device according to claim 7, including a bushing, said transmission members and said adjustment member being mounted on said bushing for performing an axial movement.

9. Device according to claim 7, including other adjustment members for angularly turning said bushing, said transmission members being connected to and actuatable by the first-mentioned adjustment member independently of at least one of said other adjustment members for angularly turning said bushing.

10. Device according to claim 6, wherein one of said adjustment elements has an annular form and is mounted on a bushing.

11. Device according to claim 10, wherein said annular adjustment element includes first and second relief members formed as fingers, which are insertable into recesses formed in a segment of the folding blade as well as in a perforation segment of the collecting cylinder.

12. Device according to claim 10, including position sensors for detecting the position of the annular adjustment element.

13. Device according to claim 10, including a lateral wall wherein said bushing is fitted so that it can turn angularly through the intermediary of other adjustment elements.

14. Device according to claim 11, including folding-blade levers fitted on a blade shaft and actuatable by said first finger-shaped relief members.

15. Device according to claim 11, including holding-element levers carried by a holding-element shaft and actuatable by said second finger-shaped relief members.

16. Device according to claim 10, wherein said annular adjustment element is provided together with a device for blocking rotation thereof on said bushing.

17. Device according to claim 6, wherein said control discs, respectively, include two separate bearing surfaces for the actuating elements for moving the folding blades and the holding elements.

18. Device according to claim 17, including a control disc holder carrying said control discs on a separately driven sleeve, said control disc holder being movable axially between positions.

19. Device according to claim 18, wherein the actuating elements, during the axial movement of said control disc holder, stop in a position remote from said control discs.

20. Device according to claim 6, wherein said actuating elements for the folding blades and for the holding elements are mounted on the collecting cylinder and constitute a single feeler roller.

21. Device according to claim 6 being in combination with convertible collecting cylinders of a folder, wherein the collecting cylinders have a diameter corresponding to an odd number of copies to be transported on the periphery thereof.

22. Device according to claim 6, including a sliding guide for initiating the axial movement of the control discs.

23. Device according to claim 22, including an angularly movable annular adjustment element having a fingerlike extension, and an adjustment member for angularly moving said annular adjustment element so as to cause said movement of the control discs between a first axial position and a second position, and in reverse.

* * * * *